US010752014B1

(12) United States Patent
Li et al.

(10) Patent No.: US 10,752,014 B1
(45) Date of Patent: Aug. 25, 2020

(54) PRINTING DEVICE, THERMAL PRINT HEAD STRUCTURE AND METHOD FOR MANUFACTURING THE THERMAL PRINT HEAD STRUCTURE

(71) Applicant: Chien Hwa Coating Technology, Inc., Hsinchu (TW)

(72) Inventors: Ming-Jia Li, Hsinchu (TW); Chih-Hui Liu, Hsinchu (TW); Yi-Wei Lin, Hsinchu (TW); Chun-Chen Chen, Hsinchu (TW)

(73) Assignee: Chien Hwa Coating Technology, Inc., Hsinchu (TW)

( * ) Notice: Subject to any disclaimer, the term of this patent is extended or adjusted under 35 U.S.C. 154(b) by 0 days.

(21) Appl. No.: 16/538,803

(22) Filed: Aug. 12, 2019

(30) Foreign Application Priority Data

May 28, 2019 (TW) ..... 108118441 A

(51) Int. Cl.
*B41J 2/335* (2006.01)

(52) U.S. Cl.
CPC ..... *B41J 2/3353* (2013.01); *B41J 2/3351* (2013.01); *B41J 2/3359* (2013.01)

(58) Field of Classification Search
CPC ..... B41J 2/3353; B41J 2/3351; B41J 2/3359
See application file for complete search history.

(56) References Cited

U.S. PATENT DOCUMENTS 5,900,622 A * 5/1999 Ogura ..... H04N 1/0316 250/208.1
6,409,309 B1 * 6/2002 Tanikawa ..... B41J 2/14072 347/54

* cited by examiner

*Primary Examiner* — Lamson D Nguyen
(74) *Attorney, Agent, or Firm* — CKC & Partners Co., LLC

(57) ABSTRACT

A thermal print head structure includes a fixed electrode layer, a movable electrode layer opposite to the fixed electrode layer, a protection layer group covering the fixed electrode layer and the movable electrode layer, a heat source used to heat the fixed electrode layer, and a number of spacers. The fixed electrode layer includes a fixed electrode line. The movable electrode layer includes a flexible electrode line which is intersected with the fixed electrode line. These spacers are located between the fixed electrode layer and the protection layer group such that gaps are defined between the fixed electrode layer and the protection layer group. When a potential difference is generated between the fixed electrode line and the flexible electrode line, the movable electrode layer contacts the fixed electrode layer through the gap.

20 Claims, 20 Drawing Sheets

PRINTING DEVICE, THERMAL PRINT HEAD STRUCTURE AND METHOD FOR MANUFACTURING THE THERMAL PRINT HEAD STRUCTURE

CROSS-REFERENCE TO RELATED APPLICATION

This application claims priority to Taiwan Application Serial Number 108118441, filed May 28, 2019, which is herein incorporated by reference.

BACKGROUND

Field of Invention

The present disclosure relates to a printing device. More particularly, the present disclosure relates to a printing device having a thermal print head structure and the thermal print head structure.

Description of Related Art

The printer complying the thermal transfer principle mainly uses a thermal print head (TPH) element to heat the ribbon, vaporize the dye on the ribbon, and transfer the dye to the transferred object (such as paper or plastic) for forming a continuous color gradation on the transferred object.

In general, a conventional TPH element includes a substrate, a glaze layer, a heating resistor layer, an electrode layer, and a protective layer which are sequentially laminated in order. When the TPH element performs the transfer process, the transferred object (e.g., thermal printer paper etc.) abuts on the protective layer so as to be relatively movable. At this moment, the heat generated by the heating resistor layer is transmitted to the transferred object for performing the desired transfer process.

However, the process of the laminated structure of the conventional TPH element is quite complicated, so that the cost and the efficiency cannot be simplified. Moreover, since the sintering temperature of the glaze layer of the conventional TPH is so high, the loading substrate must be made of ceramic or silicon crystal material, and the size of the currently available TPH element can only be up to 12 inches maximum. Thus, a large size of the TPH element is not available, or a large-scale printed product cannot be produced at one time.

SUMMARY

One aspect of the disclosure is to provide a printing device, a thermal print head structure and a method for manufacturing the thermal print head structure so as to improve the efficiency of the thermal print head structure, thereby improving the overall transfer efficiency.

One aspect of the disclosure is to provide a printing device, a thermal print head structure and a method for manufacturing the thermal print head structure so as to provide a thermal print head structure with a large-sized substrate, which can solve the deficiencies that the printing device with the above-mentioned thermal energy transfer principle cannot be enlarged, or cannot produce a large-sized printing product at one time.

According to one embodiment of the present disclosure, a thermal print head structure is provided, and the thermal print head structure includes a substrate, a fixed electrode layer, at least one movable electrode layer, a protection layer group, a plurality of spacers and a heat source. The fixed electrode layer is disposed on the substrate, and the fixed electrode layer includes at least one fixed electrode line. The movable electrode layer is opposite to the fixed electrode layer, and the movable electrode layer includes a flexible electrode line which is intersected with the fixed electrode line. The protection layer group covers the substrate, the fixed electrode layer and the movable electrode layer. The spacers are located between the fixed electrode layer and the protection layer group, so that at least one gap is defined therebetween, and aligned with an intersection of the flexible electrode line and the fixed electrode line. The heat source is used to heat the fixed electrode layer through the substrate. Thus, when a first potential difference is generated between the flexible electrode line and the fixed electrode line, a portion of the movable electrode layer is moved into the gap to physically contact with the fixed electrode layer in the gap. When a second potential difference is generated between the flexible electrode line and the fixed electrode line, the portion of the movable electrode layer is withdrawn from the gap, wherein the second potential difference is less than the first potential difference.

According to another embodiment of the present disclosure, a printing device is provided, and the printing device includes a placement portion, an ink ribbon, a voltage source and the aforementioned thermal print head structure. The placement portion is used to be placed with a transfer-printed object thereon. The ink ribbon is disposed between the placement portion and the thermal print head structure, and disposed on one surface of the protection layer group opposite to the fixed electrode layer. The voltage source is respectively electrically connected to the fixed electrode line and the flexible electrode line. When the second potential difference is generated between the flexible electrode line and the fixed electrode line by the voltage source, the portion of the movable electrode layer which is withdrawn from the gap thermally presses the ink ribbon with the protection layer group so that inks of the ink ribbon is transferred onto the transfer-printed object.

According to another embodiment of the present disclosure, a printing device is provided, and the printing device includes a micro electro mechanical system (MEMS) switch assembly, a heat source, an ink ribbon and a voltage source. The MEMS switch assembly includes a first side surface, a second side surface and a plurality of transfer switches. The second side surface is opposite to the first side surface. The transfer switches are arranged between the first side surface and the second side surface in accordance with an array arrangement. Each of the transfer switches includes a fixed electrode region, a movable electrode region, and a gap. The gas is located between the fixed electrode region and the movable electrode region, and the movable electrode region is allowed to move into the gap. The heat source is disposed at the first side surface. The ink ribbon is disposed at the second side surface of the MEMS switch assembly. The voltage source is electrically connected to the transfer switches, and used to switch any of the transfer switches for moving the movable electrode region to one of the fixed electrode region and the ink ribbon via the gap.

According to another embodiment of the present disclosure, a method for manufacturing a thermal print head structure includes steps as follows. A substrate is provided. A fixed electrode layer is formed on the substrate, and the fixed electrode layer includes plural fixed electrode lines. A sacrificial layer is formed on the fixed electrode layer. Plural spacers are formed in the sacrificial layer, and the spacers are separately arranged in the sacrificial layer in accordance with an array arrangement. Plural movable electrode layers are formed on one surface of the sacrificial layer being opposite to the fixed electrode layer, and each of the movable electrode layers includes a flexible electrode line which is intersected with each of the fixed electrode lines. A protection layer group is formed to cover the substrate, the fixed electrode layer and the movable electrode layers. The sacrificial layer is removed such that the spacers separate a plurality of gaps between the fixed electrode layer and the protection layer group.

Provided above is merely a brief introduction of the problems to be solved, the technical means to solve the problem and the technical effects of the present disclosure. The specific details of the present disclosure are provided in the following embodiments and drawings.

BRIEF DESCRIPTION OF THE DRAWINGS

The disclosure can be more fully understood by reading the following detailed description of the embodiment, with reference made to the accompanying drawings as follows.

DETAILED DESCRIPTION

The following embodiments are disclosed with accompanying diagrams for a detailed description. For illustration clarity, many details of practice are explained in the following descriptions. However, it should be understood that these details of practice do not intend to limit the present disclosure. That is, these details of practice are not necessary for parts of embodiments of the present disclosure. Furthermore, for simplifying the drawings, some of the conventional structures and elements are shown with schematic illustrations.

Figure 1:
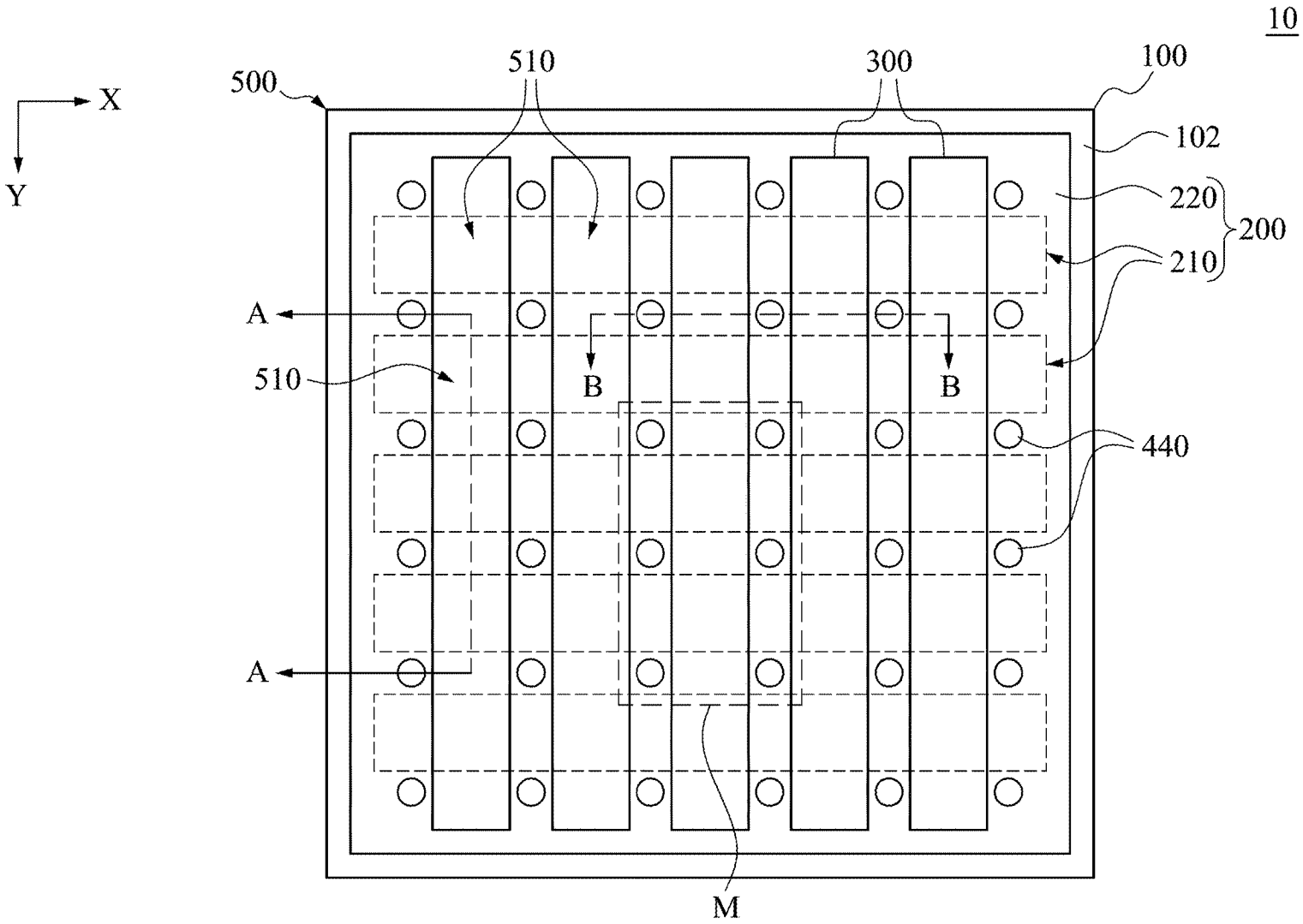
FIG. 1 is a top view of a thermal print head structure according to an embodiment of the present disclosure.
Figure 2:
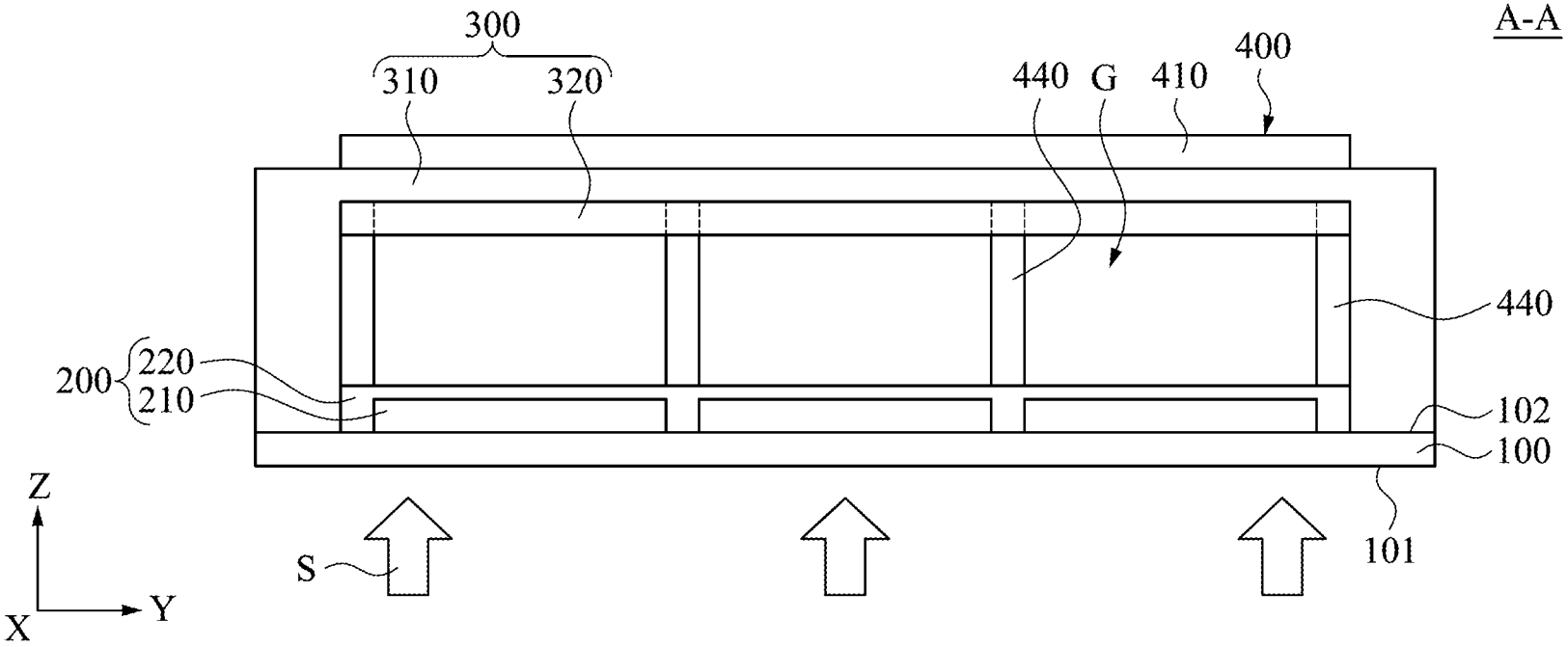
FIG. 2 is a cross-sectional view viewed along a line A-A of FIG. 1.
Figure 3:
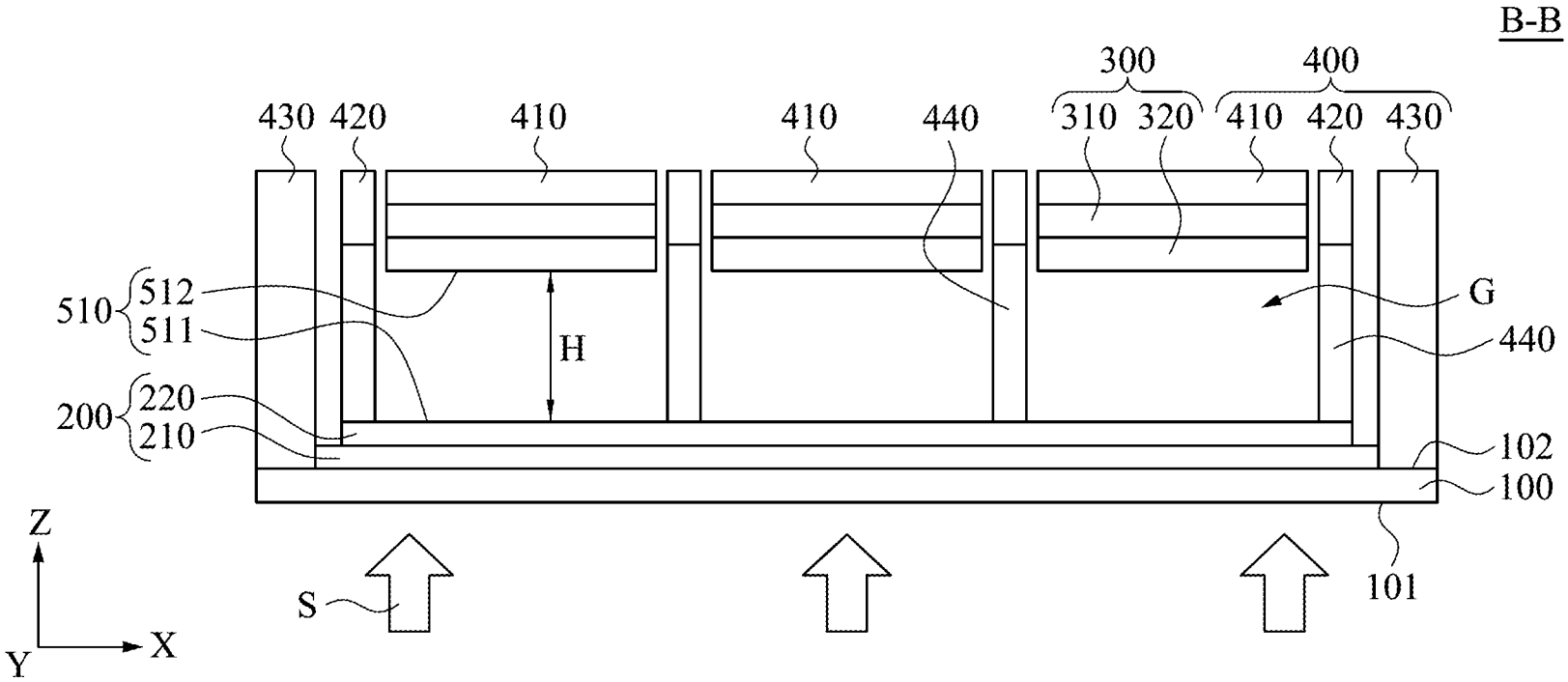
FIG. 3 is a cross-sectional view viewed along a line B-B of FIG. 1.

Reference is now made to FIG. 1 to FIG. 3 in which FIG. 1 is a top view of a thermal print head structure 10 according to an embodiment of the present disclosure, FIG. 2 is a cross-sectional view viewed along a line A-A of FIG. 1, and FIG. 3 is a cross-sectional view viewed along a line B-B of FIG. 1 wherein the line A-A and line B-B are orthogonal to each other. It is noted that FIG. 1 is a schematic view of the thermal print head structure 10 seen through a protection layer group 400. As shown in FIG. 1 to FIG. 3, the thermal print head structure 10 includes a heat source S, a substrate 100, a fixed electrode layer 200, a protection layer group 400, a plurality of movable electrode layers 300 and a plurality of spacers 440. The substrate 100 includes a bottom surface 101 and a top surface 102 which are opposite to each other, and the bottom surface 101 and the top surface 102 respectively are the largest main surfaces of the substrate 100. The fixed electrode layer 200 is disposed on the top surface 102 of the substrate 100, and interposed between the substrate 100 and the movable electrode layers 300. The fixed electrode layer 200 includes a plurality of fixed electrode lines 210. The fixed electrode lines 210 are separately arranged on the top surface 102 of the substrate 100. The movable electrode layers 300 are separately arranged on the same planar. Each of the movable electrode layers 300 is disposed opposite to the fixed electrode layer 200. The movable electrode layers 300 are separately arranged, and each of the movable electrode layers 300 linearly extends in a long axis direction (e.g., Y axis direction). Each of the movable electrode layers 300 includes a flexible electrode line 310. The flexible electrode lines 310 are respectively intersected with the fixed electrode lines 210. For example, the fixed electrode lines 210 are arranged in parallel with each other, and the flexible electrode lines 310 are arranged in parallel with each other, and a long axis direction (e.g., Y-axis direction) of each of the flexible electrode lines 310 and long axis direction (e.g., X-axis direction) of each of the fixed electrode lines 210 are orthogonal to each other.

The protection layer group 400 covers the top surface 102 of the substrate 100, the spacers 440, the fixed electrode layer 200 and the movable electrode layers 300. The spacers 440 are located between the fixed electrode layer 200 and the protection layer group 400, so that plural gaps G are defined therebetween, and the gaps G are separately arranged on the same planar. For example, each height H of each of the gaps G is between 100-110 micrometers. Each of the gaps G is aligned with an intersection of one of the flexible electrode lines 310 and one of the fixed electrode lines 210. The heat source S is used to heat the fixed electrode layer 200 through the substrate 100. For example, the heat source S is located on the surface of the substrate 100 opposite to the fixed electrode layer 200, that is, the bottom surface 101 of the substrate 100. The heat source S is thermally coupled to and in direct contact with the bottom surface 101 of the substrate 100 for conducting thermal energy to the substrate 100 and the fixed electrode layer 200. However, the disclosure is not limited to the placement position of the heat source S. Thus, through the above structure, the efficiency of the thermal print head structure 10 can be improved, thereby improving the overall transfer efficiency.

Figure 4:
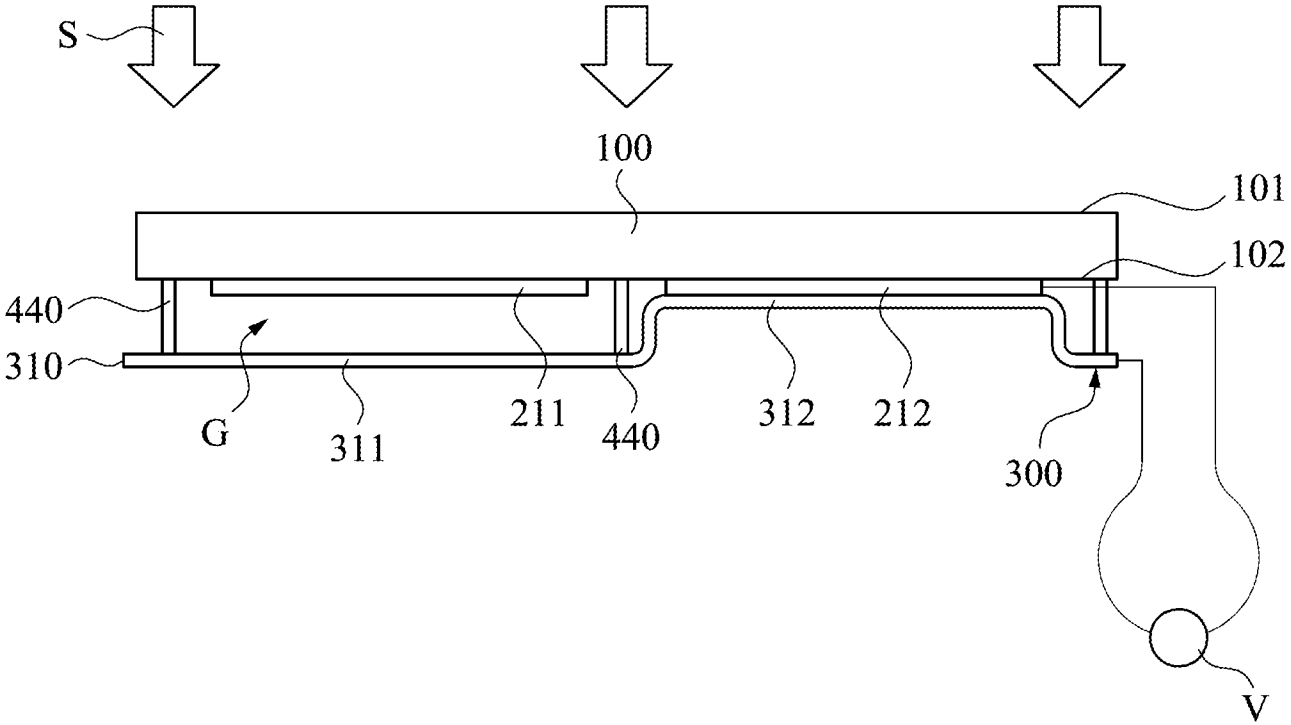
FIG. 4 is an operation schematic view of a region M of FIG. 1.

FIG. 4 is an operation schematic view of a region M of FIG. 1, in which a fixed electrode line (called left fixed electrode line 211 hereinafter) is located on the left side of FIG. 4, another fixed electrode line (called right fixed electrode line 212 hereinafter) is located on the right side of FIG. 4, and one flexible electrode line 310 of the movable electrode layer 300 is located below the left fixed electrode line 211 and the right fixed electrode line 212. As shown in FIG. 2 to FIG. 4, when a voltage source V supplies power to the flexible electrode line 310 and the right fixed electrode line 212 only so as to generate a first potential difference between the flexible electrode line 310 and the right fixed electrode line 212, a portion 312 of the movable electrode layer 300 corresponding to the right fixed electrode line 212 is concaved to be moved into the corresponding gap G so as to physically contact with the right fixed electrode layer 212. More specifically, the portion 312 of the movable electrode layer 300 is drawn by the right fixed electrode layer 212 such that the portion 312 of the movable electrode layer 300 which is the intersection of the flexible electrode line 310 and the right fixed electrode line 212 is in direct contact with the right fixed electrode layer 212. For example, the portion 312 of the movable electrode layer 300 is attached onto the fixed electrode layer 200 via the gap G so as to gather the heat from the heat source S. Thus, at this time, the thermal print head structure 10 enters a heat storing phase.

Refer to FIG. 4 again, on the other hand, when the voltage source V stops supplying power to, or at least reduces electric power to the flexible electrode line 310 and the left fixed electrode line 211 such that a second potential difference being less than the first potential difference is generated between the flexible electrode line 310 and the left fixed electrode line 211, only the portion 311 of the movable electrode layer 300 corresponding to the left fixed electrode line 211 is withdrawn from the corresponding gap G for physically contacting with an ink ribbon. In other words, the portion 311 of the movable electrode layer 300 is elastically drawn back to the original position from the left fixed electrode line 211 of the fixed electrode layer 200 via the gap G due to the resilience of a metal film (i.e., left fixed electrode line 211), so that the portion 311 of the movable electrode layer 300 thermally presses an ink ribbon with the heat gathered from the heat source S. Thus, at this time, the thermal print head structure 10 enters a transfer-printing phase.

More specifically, in the current embodiment, refer to FIG. 3, the fixed electrode layer 200 further includes a first dielectric layer 220. The first dielectric layer 220 covers all of the fixed electrode lines 210 and the top surface 102 of the substrate 100, and the first dielectric layer 220 is located between any two adjacent ones of the fixed electrode lines 210. The first dielectric layer 220 protects all of the fixed electrode lines 210. For example, the first dielectric layer 220 includes hafnium oxide, tantalum nitride or the like, and the fixed electrode line 210 includes aluminum, copper or the like.

In addition, each of the movable electrode layers 300 further includes a second dielectric layer 320. The second dielectric layer 320 is used to fix the flexible electrode lines 310 on the protection layer group 400, and the flexible electrode line 310 of each of the movable electrode layer 300 is sandwiched between the second dielectric layer 320 and the protection layer group 400 so as to be protected by the second dielectric layer 320. Each of the flexible electrode lines 310 covers the second dielectric layer 320 and the gaps G in the long axis direction (e.g., Y-axis direction) of each flexible electrode line 310, and two opposite ends of each of the flexible electrode lines 310 extend in the Z-axis direction towards the substrate 100 to connect to the top surface 102 of the substrate 100 (FIG. 2). For example, the second dielectric layer 320 includes germanium dioxide, tantalum nitride, or the like, and the flexible electrode line 310 includes aluminum, copper, or the like.

The spacers 440 are arranged between the fixed electrode layer 200 and the protection layer group 400 in an array manner (for example, a matrix or a checkerboard pattern). Each of the fixed electrode lines 210 is located between any two rows of the spacers 440 along the X axis. Each of the flexible electrode lines 310 is located between any two columns of spacers 440 along the Y axis. For example, each gap G can be surrounded by every four spacers 440. The protection layer group 400 covers the top surface 102 of the substrate 100, all of the spacers 440, the fixed electrode layer 200 and the movable electrode layer 300.

The protection layer group 400 includes plural first protective films 410, plural second protective films 420 and plural outer sidewalls 430. Each of the first protective films 410 is disposed between any two adjacent ones of the second protective films 420, and located on the movable electrode layer 300. Each of the flexible electrode lines 310 is sandwiched between the corresponding second dielectric layer 320 and the corresponding first protective film 410. Each of the first protective films 410 is moved together with the movable electrode layer 300, that is, the first protective film 410 is relatively displaceable to each of the second protective films 420. Each of the second protective films 420 is located on one end of the spacer 440 opposite to the fixed electrode layer 200. The outer sidewalls 430 of the protection layer group 400 respectively extend towards the substrate 100 in the Z-axis direction to stand on the top surface 102 of the substrate 100. The first protective film 410, the second protective film 420, the spacer 440 and the gap G are both located between any two outer sidewalls 430.

For example, the protection layer group 400 and the spacers 440 include SiON or the like, respectively. The protection layer group 400 and the spacers 440 may be the same or different in material. Furthermore, in the present embodiment, the substrate 100 is the high heat storage substrate. The first potential difference is, for example, 6 to 10 volts, and the second potential difference is, for example, 0 to 4 volts, 1 to 4 volts, 2 to 4 volts, or 0 volts.

In the present embodiment, the thermal print head structure 10 includes a micro electro mechanical system (MEMS) switch assembly 500. The MEMS switch assembly 500 is a microsystem integrated into a single or multiple wafers according to micro electro mechanical system (MEMS) technology, and the micro electro mechanical system (MEMS) switch assembly 500 includes a plurality of transfer switches 510. The transfer switches 510 are horizontally arranged in an array. Each transfer switches 510 includes a fixed electrode region 511, a movable electrode region 512 and a gap G. The gap G is located between the fixed electrode region 511 and the movable electrode region 512, and the movable electrode region 512 is allowed to move into the gap G. Each of the aforementioned transfer switches 510 is formed at an intersection position (i.e., the fixed electrode region 511 and the movable electrode region 512 which are aligned with the corresponding gap G) of one of the flexible electrode lines 310 and one of the fixed electrode lines 210. The two opposite sides of the micro electro mechanical system (MEMS) switch assembly 500 correspond to the substrate 100 and the protection layer group 400, respectively.

As such, refer to FIG. 3 and FIG. 4, when the concave portion 312 of the movable electrode layer 300 physically contacts with the right fixed electrode line 212 of the fixed electrode layer 200 via the gap G, the movable electrode region 512 of the transfer switches 510 physically contacts the fixed electrode region 511 via the gap G. On the contrary, when the concave portion 311 of the movable electrode layer 300 is drawn back to the original position via the gap G (FIG. 4), the movable electrode region 512 of the transfer switch 510 is drawn back to the original position via the gap G (FIG. 3).

It is to be understood that the MEMS switch is a switch constructed of tiny structures made by semiconductor manufacturing technology. The movable electrode of the MEMS switch has a single-arm beam or a double-arm beam, a diaphragm type, and the like, and the on/off mode of the MEMS switch is not limited, for example, using an electrostatic force or a magnetic force. However, the disclosure is not limited thereto, and the disclosure is not limited to the type of MEMS switch.

Figure 5:
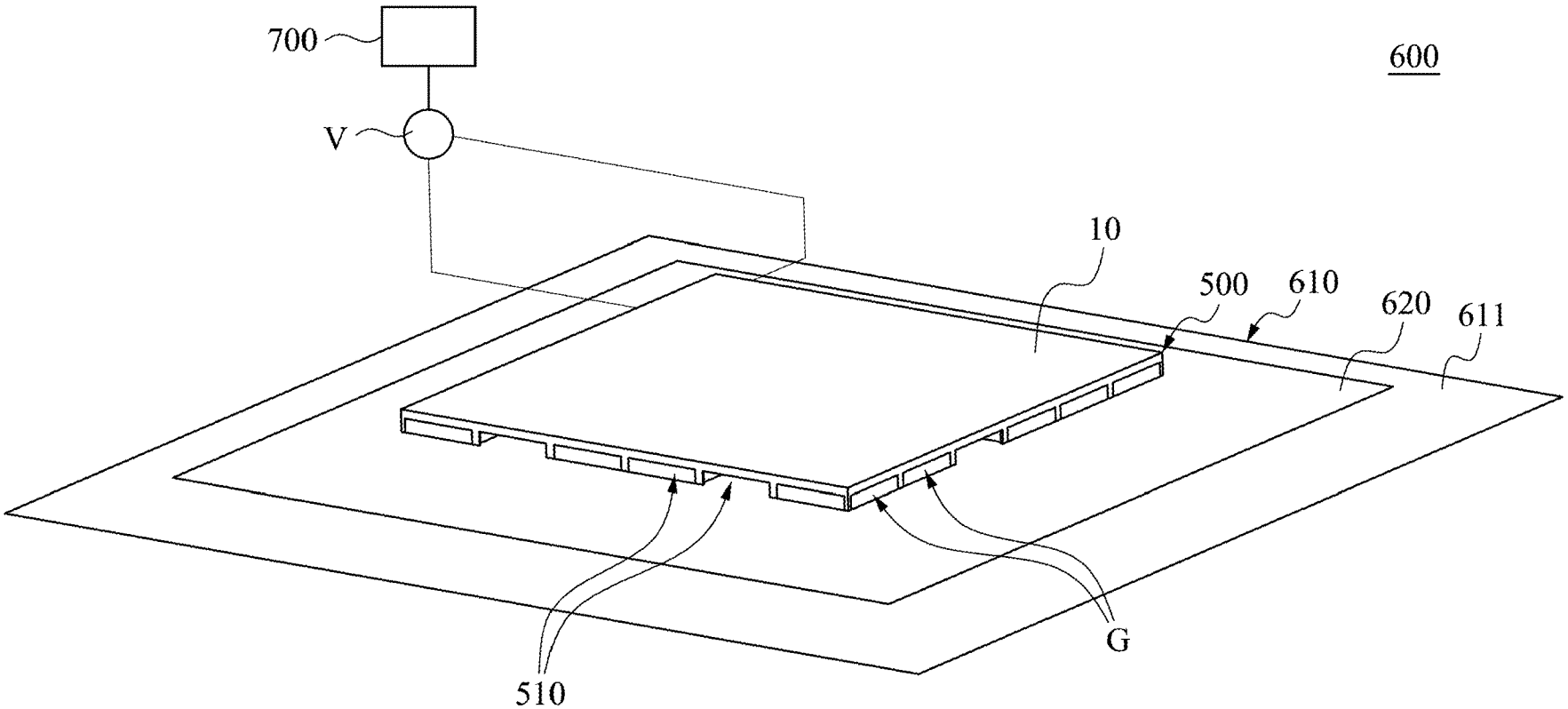
FIG. 5 is a schematic view of a printing device according to an embodiment of the present disclosure.

FIG. 5 is a schematic view of a printing device according to an embodiment of the present disclosure. As shown in FIG. 2 and FIG. 5, the printing device 600 includes a placement portion 610, an ink ribbon 620, a control unit 700, a voltage source V and the aforementioned thermal print head structure 10. The placement portion 610 is used to be placed with a transfer-printed object 611 thereon. The transfer-printed object 611 for example is a paper or a plastic sheet. The ink ribbon 620 is disposed between the placement portion 610 and the thermal print head structure 10, and the ink ribbon 620 is disposed on one surface of the protection layer group 400 opposite to the heat source S for contacting the protection layer group 400 of the thermal print head structure 10. The ink ribbon 620 is, for example, a sublimation ribbon or other thermal transfer ribbon. The voltage source V is electrically connected to all of the fixed electrode lines 210 of the fixed electrode layer 200 and all of the flexible electrode lines 310 of the movable electrode layer 300, respectively. The control unit 700 is electrically connected the voltage source V and the heat source S, and is used for controlling the heat source S to heat the fixed electrode layer 200 through the substrate 100 according to a specific execution signal, and generating an potential difference between the fixed electrode region 511 and the movable electrode region 512 (FIG. 3) of the corresponding one of the transfer switches 510 of the MEMS switch assembly 500.

Figure 6A:
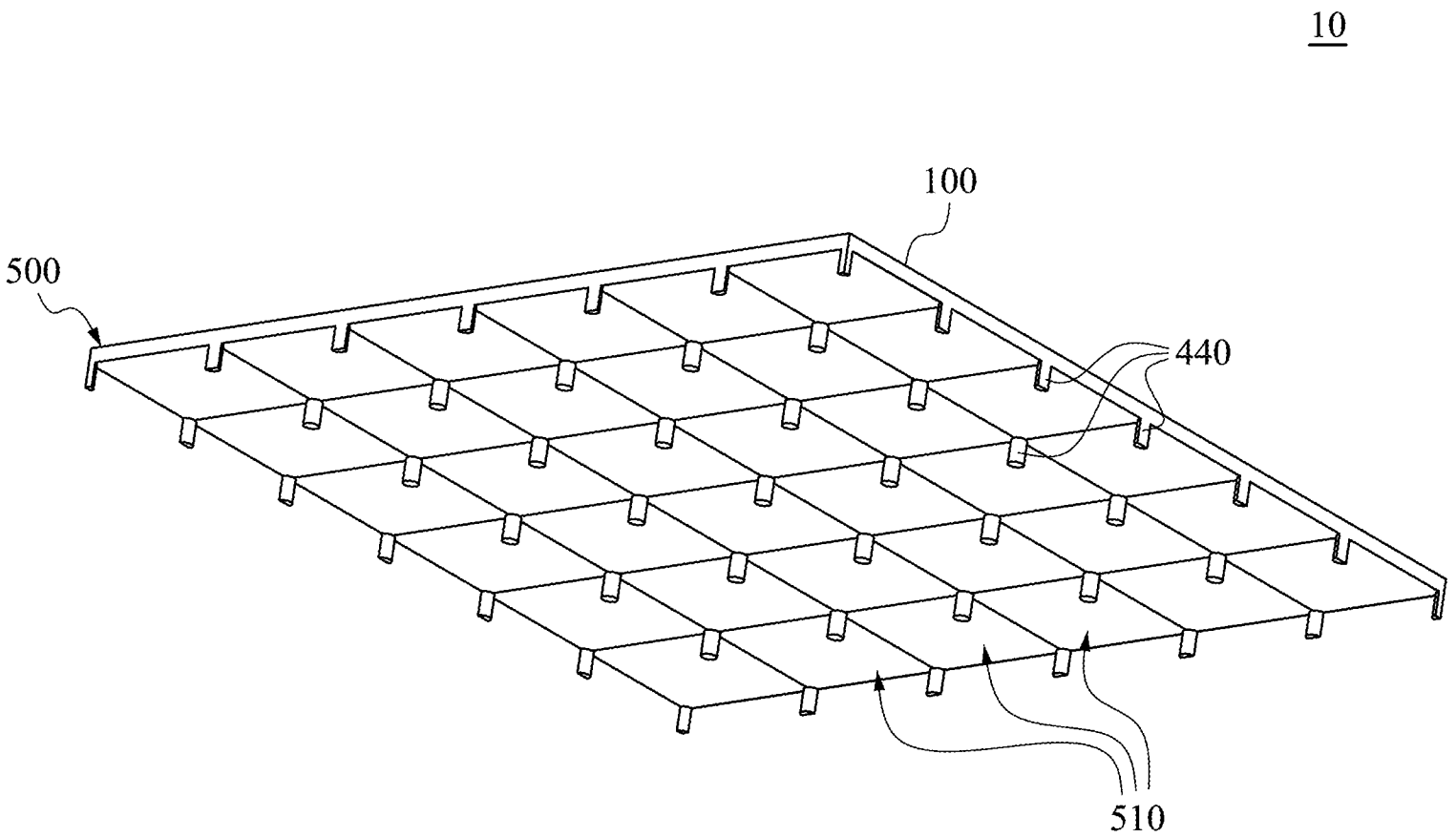
FIG. 6A is an operation schematic view of the printing device of FIG. 5 in a heat-storing phase.

FIG. 6A is an operation schematic view of the printing device 600 of FIG. 5 in a heat-storing phase. As shown in FIG. 5 and FIG. 6A, when the control unit 700 receives the execution signal to enter a heat-storing phase, by controlling of the control unit 700, the voltage source V supplies power to all of the fixed electrode lines 210 (FIG. 2) and all of the flexible electrode lines 310 (FIG. 3) so that each of the movable electrode regions 512 of all of the transfer switches 510 is able to physical contact with the corresponding fixed electrode region 511 (i.e., the fixed electrode layer 200). Thus, each of the movable electrode regions 512 is heated by the corresponding fixed electrode region 511 (i.e., the fixed electrode layer 200).

Figure 6B:
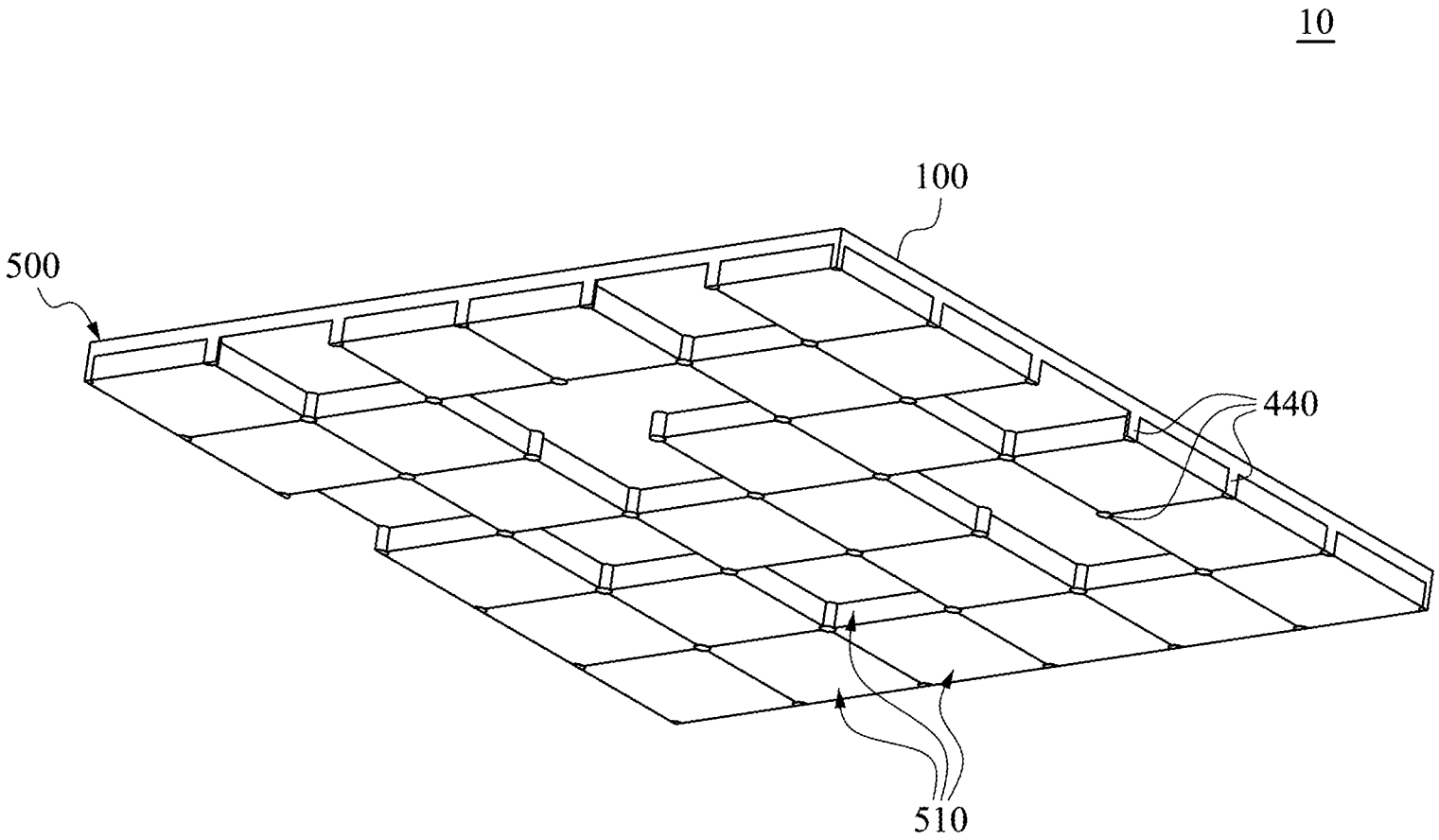
FIG. 6B is an operation schematic view of the printing device of FIG. 5 in a transfer-printing phase.

FIG. 6B is an operation schematic view of the printing device 600 of FIG. 5 in a transfer-printing phase. As shown in FIG. 5 and FIG. 6B, after the heat storage phase is completed, when the control unit 700 receives an execution signal to enter an ink-printing phase, the voltage source V is controlled by the control unit 700 to supply power only to the specific flexible electrode lines 310 and the fixed electrode lines 210, so that the movable electrode region 512 of the corresponding transfer switches 510 are drawn back to the original position from the gap G, and in physical contact with the ink ribbon 620, thereby thermally transferring the ink of the ink ribbon 620 to the transfer-printed object 611 (FIG. 6C).

Figure 6C:
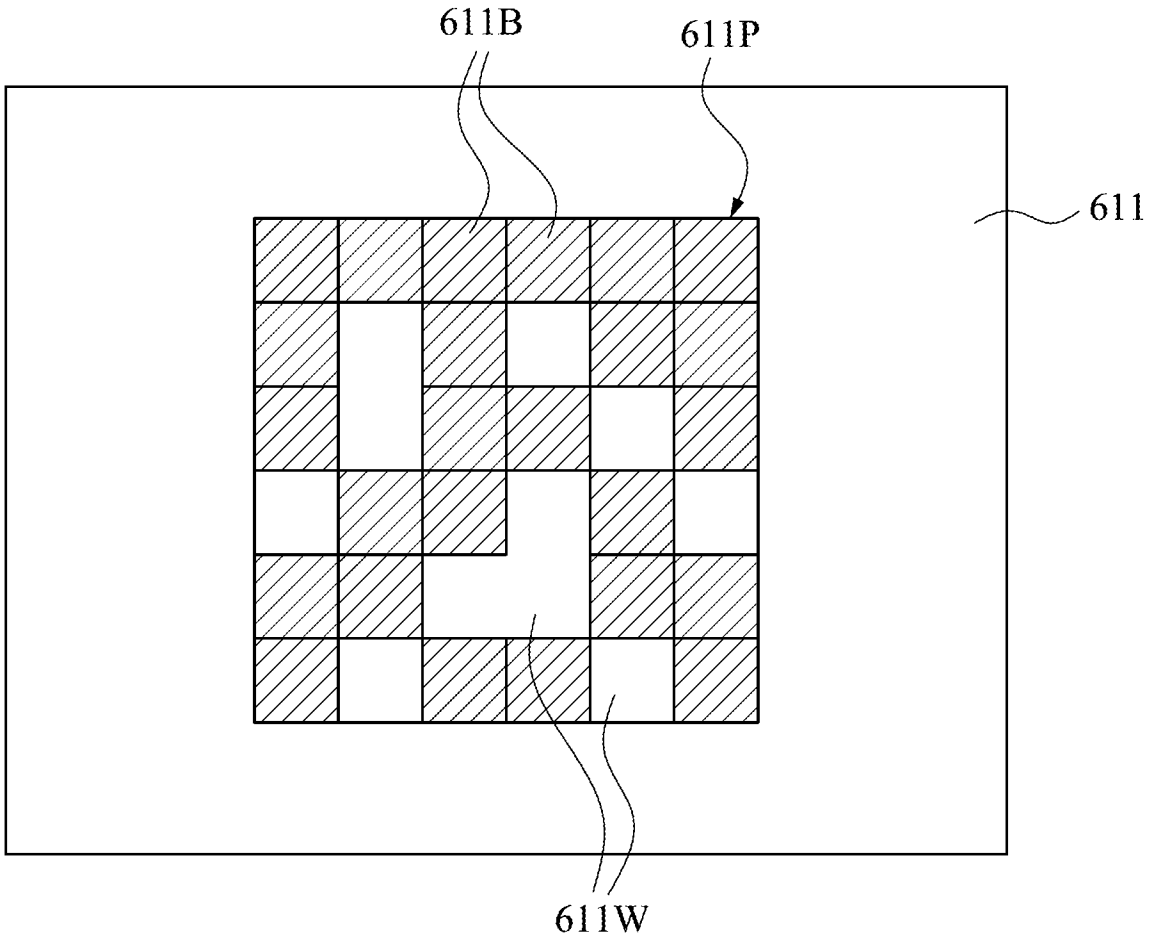
FIG. 6C is a schematic view of a transfer-printed object produced by the printing device of FIG. 5.

FIG. 6C is a schematic view of a transfer-printed object 611 produced by the printing device 600 of FIG. 5. As shown in FIG. 6B and FIG. 6C, since the movable electrode regions 512 of the specific transfer switches 510 are thermally pressed on the ink ribbon 620, and those of the remaining transfer switches 510 are not, thus, inked regions 611B corresponding to the specific transfer switches 510 are correspondingly printed on the transfer-printed object 611 through the ink ribbon 620, and blank regions 611W corresponding to the remaining transfer switches 510 are left on the transfer-printed object 611. Thereby, a predetermined pattern 611P is therefore shown on the transfer-printed object 611 (FIG. 6C).

Figure 7B:
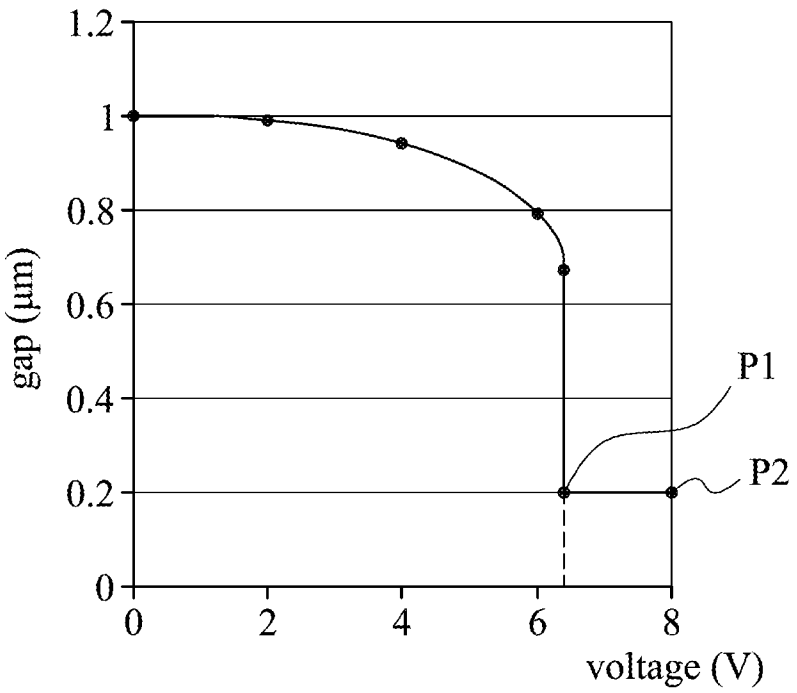
FIG. 7A and FIG. 7B are voltage-pitch relationship diagrams of the printing device of FIG. 6A in the heat-storing phase.
Figure 7A:
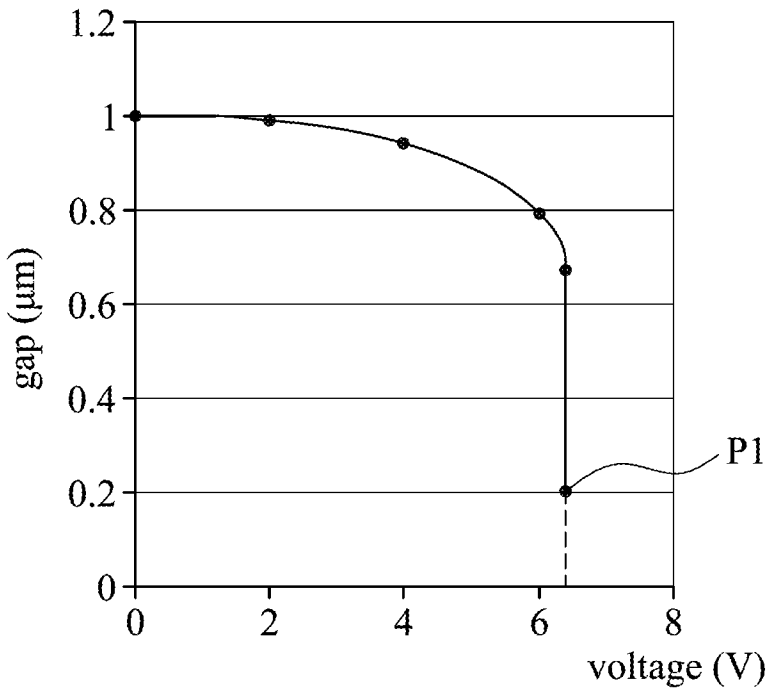

FIG. 7A and FIG. 7B are voltage-pitch relationship diagrams of the printing device 600 of FIG. 6A in the heat-storing phase. As shown FIG. 2 and FIG. 7B, in order to prevent the movable electrode region 512 of the transfer switch 510 from being not in tight contact with the fixed electrode region 511 (i.e., the fixed electrode layer 200) during the heat-storing phase so as to cause poor heat storage effect, thus, when the corresponding fixed electrode line 210 and the flexible electrode line 310 are powered to a first critical point P1 of the first potential difference in the heat-storing phase, the control unit 700 further requests the voltage source V to slightly increase the first potential difference (FIG. 5) so as to increase from the first critical point P1 to the second critical point P2 (FIG. 7B), for example, from 8 volts to 10 volts, thereby increasing the displacement of the movable electrode region 512 of the transfer switch 510 to the fixed electrode layer 200, and strengthening a pressing force of the movable electrode region 512 against the fixed electrode region 511. Thus, it is further ensured that the efficiency of the movable electrode region 512 of the transfer switch 510 for gathering heat storage.

Figure 8B:
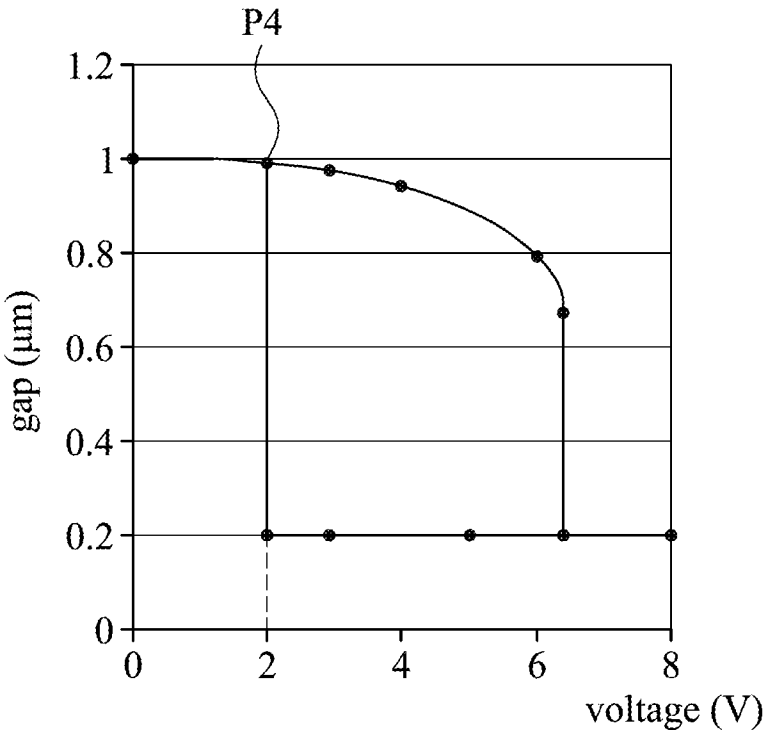
FIG. 8A and FIG. 8B are voltage-pitch relationship diagrams of the printing device of FIG. 6A in the transfer-printing phase.
Figure 8A:
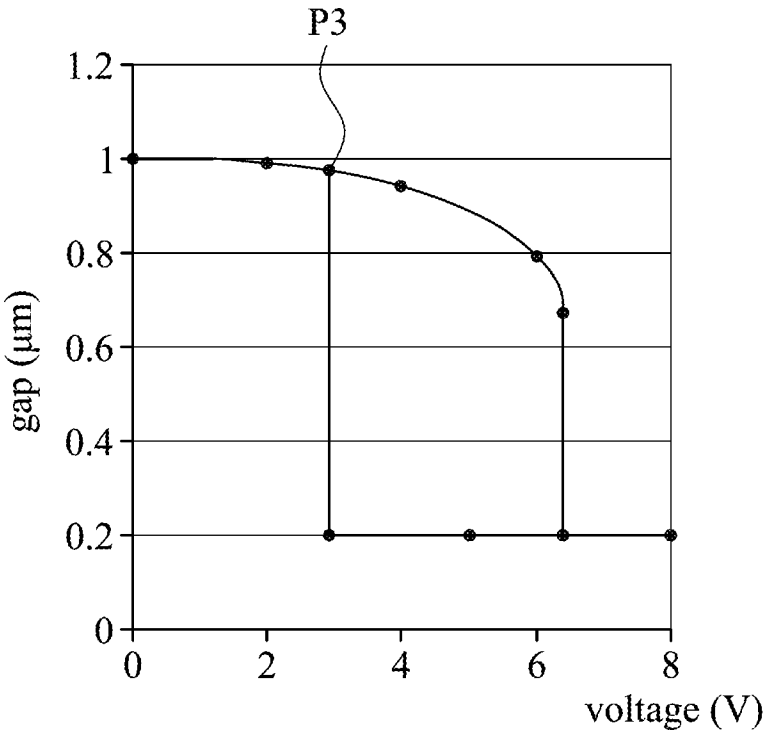

FIG. 8A and FIG. 8B are voltage-pitch relationship diagrams of the printing device 600 of FIG. 6A in the transfer-printing phase. As shown FIG. 5 and FIG. 8A, in order to prevent the movable electrode region 512 of the transfer switch 510 from being not in tight contact with the ink ribbon during the transfer-printing phase, thus, when the printing device 600 is in the transfer-printing phase, that is, the corresponding fixed electrode line 210 and the flexible electrode line 310 are powered to a third critical point P3 of the second potential difference in the transfer-printing phase, the control unit 700 further requests the voltage source V to slightly decrease the send potential difference (FIG. 5) so as to decrease from the third critical point P3 to the fourth critical point P4 (FIG. 8B), for example, from 3 volts to 2 volts. Thus, the drawing force of the movable electrode region 512 of the transfer switch 510 towards the fixed electrode layer 200 can be further eliminated, that is, the movable electrode layer 300 can be pulled back to the original position by the resilience of the movable electrode layer 300 so as to strengthen a pressing force of the movable electrode region 512 onto the ink ribbon 620. Thus, it is further ensured that the efficiency of the movable electrode region 512 of the transfer switch 510 for thermally pressing on the ink ribbon.

Figure 9:
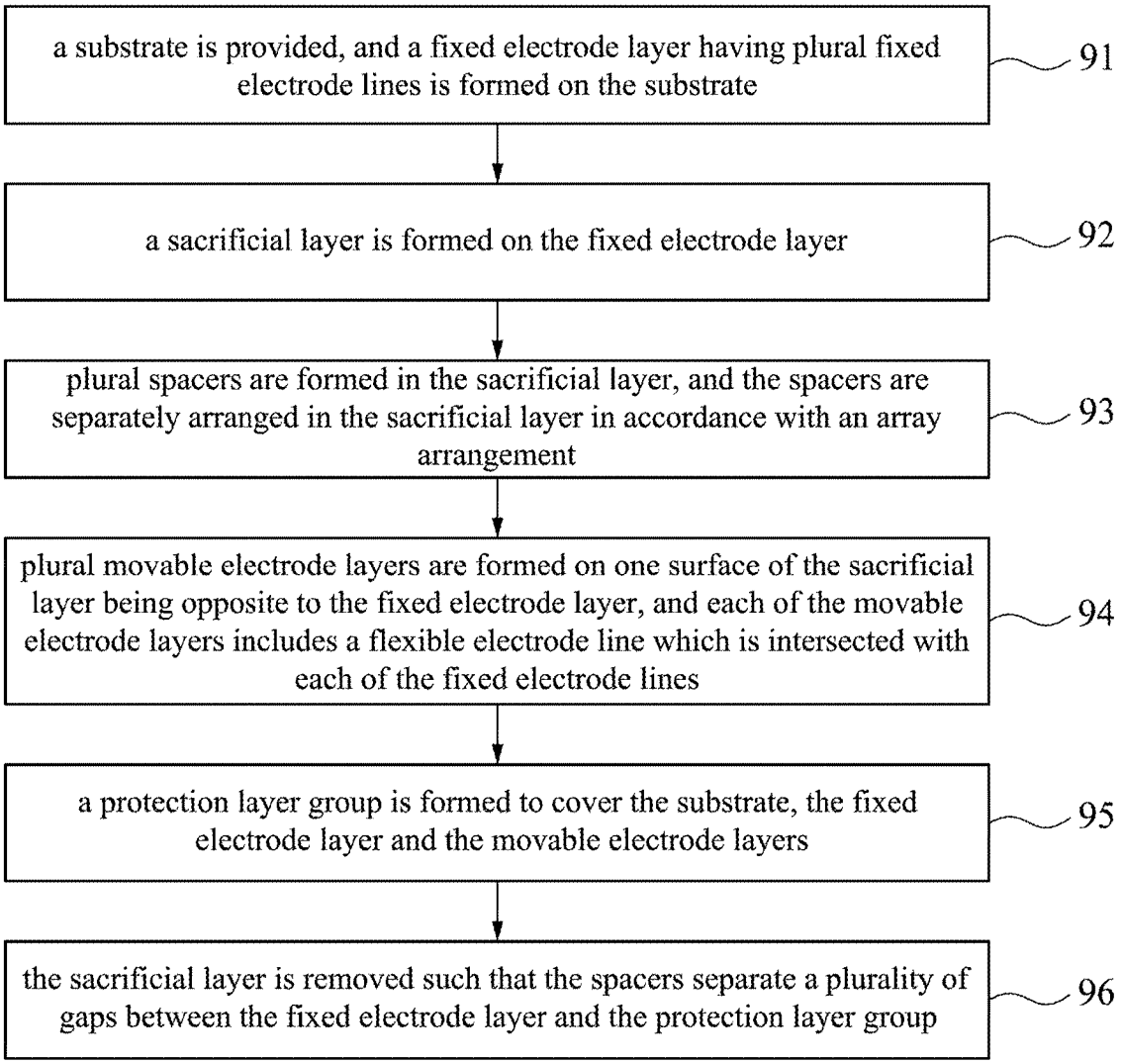
FIG. 9 is a flow chart of a method of manufacturing a thermal print head structure according to one embodiment of the disclosure.

FIG. 9 is a flow chart of a method of manufacturing a thermal print head structure 10 according to one embodiment of the disclosure. As shown FIG. 9, the method for manufacturing a thermal print head structure 10 includes step 91 to step 96 described as follows. In step 91, a substrate is provided, and a fixed electrode layer having plural fixed electrode lines is formed on the substrate. In step 92, a sacrificial layer is formed on the fixed electrode layer. In step 93, plural spacers are formed in the sacrificial layer, and the spacers are separately arranged in the sacrificial layer in accordance with an array arrangement. In step 94, plural movable electrode layers are formed on one surface of the sacrificial layer being opposite to the fixed electrode layer, and each of the movable electrode layers includes a flexible electrode line which is intersected with each of the fixed electrode lines. In step 95, a protection layer group is formed to cover the substrate, the fixed electrode layer and the movable electrode layers. In step 96, the sacrificial layer is removed such that the spacers separate a plurality of gaps between the fixed electrode layer and the protection layer group.

Figure 10A:
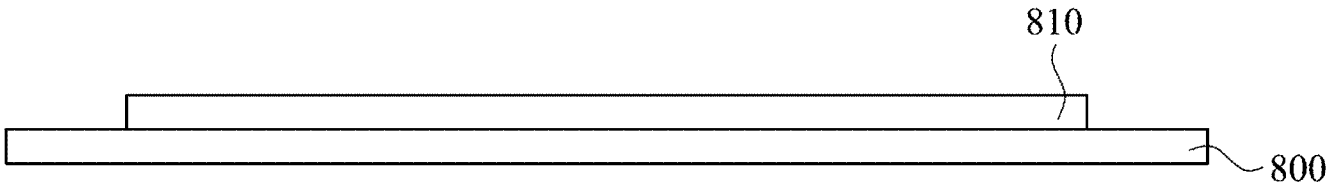
FIG. 10A to FIG. 10C are continual schematic side views of detailed steps of a step 91 of FIG. 9.
Figure 10B:
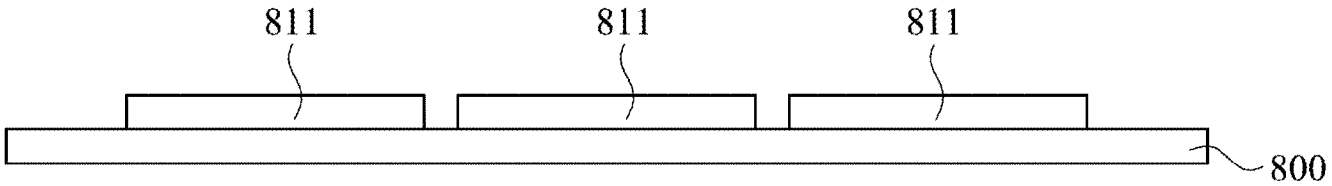
Figure 10C:
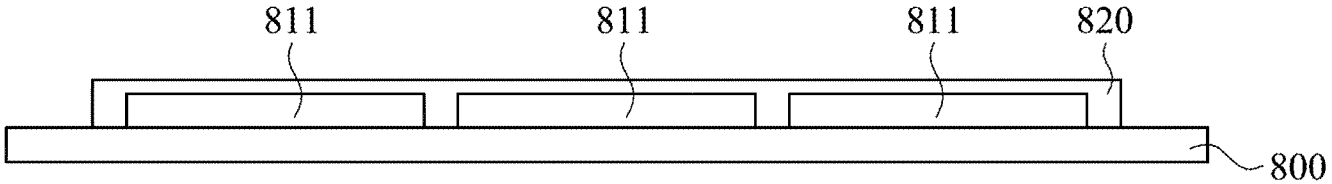

FIG. 10A to FIG. 10C are continual schematic side views of detailed steps of the step 91 of FIG. 9. More specifically, as shown in FIGS. 10A to 10C, the step 91 further includes detailed steps as follows. A metal film 810 is formed on the substrate 800 according to a film coating method (FIG. 10A). Next, the metal film 810 on the substrate 800 is processed through a variety of processes such as lithography, etching, and photoresist removal, so that the fixed electrode lines 811 are formed to be spaced apart (FIG. 10B). Next, a dielectric film is formed on the substrate 800 according to a film coating method, and then the dielectric film is processed through a variety of processes such as lithography, etching, and photoresist removal, so as to form a first dielectric layer 820 on the substrate 800 in which the first dielectric layer 820 covers all of the fixed electrode lines 811 and the top surface 102 of the substrate 800 (FIG. 10C).

Figure 11A:
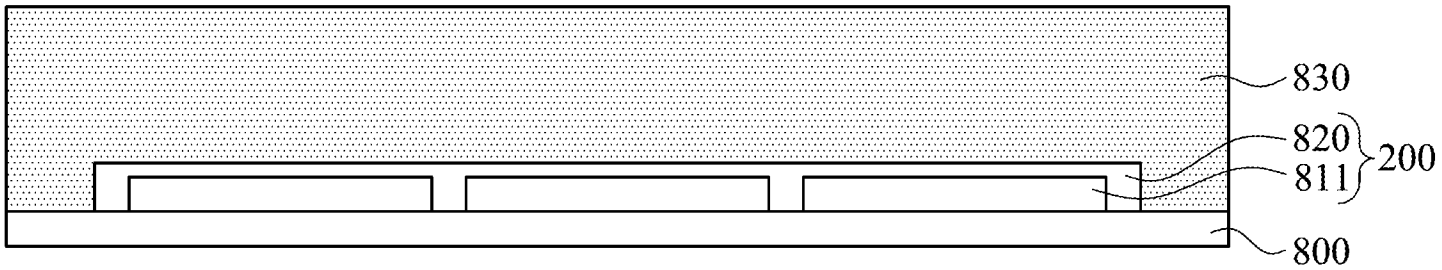
FIG. 11A to FIG. 11B are continual schematic side views of detailed steps of a step 92 of FIG. 9.
Figure 11B:
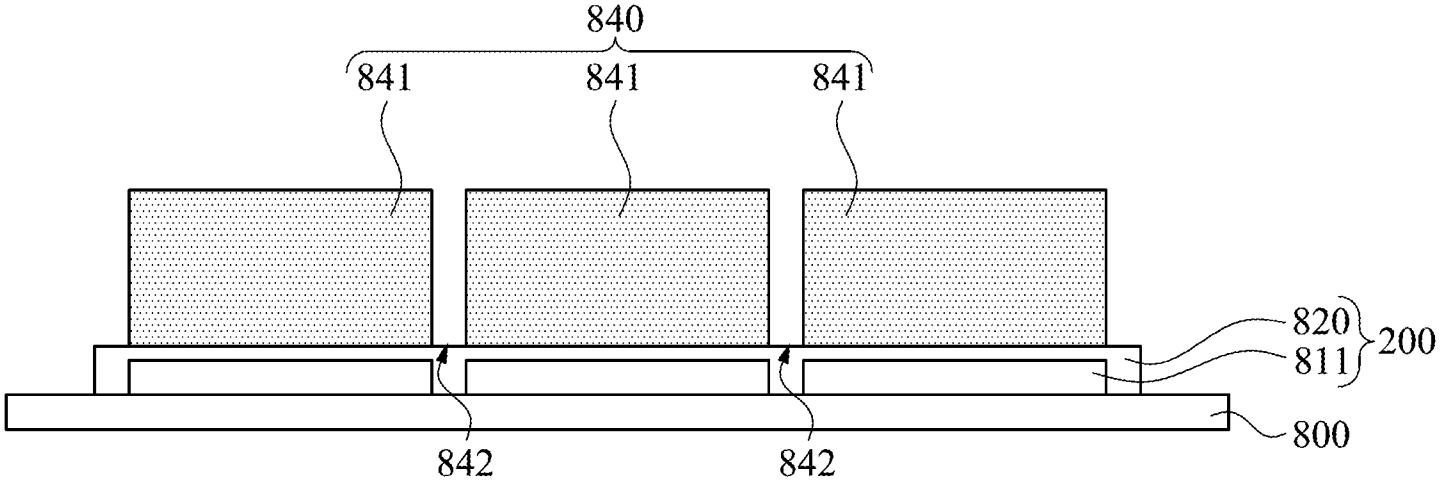

FIG. 11A and FIG. 11B are continual schematic side views of detailed steps of the step 92 of FIG. 9, and FIG. 11B is the side view of FIG. 11A. More specifically, as shown in FIG. 11A and FIG. 11B, the step 92 further includes detailed steps as follows. A sacrificial material 830 is formed on the substrate 800 and the fixed electrode layer 200 according to a film coating method. Next, a number of blocks 841 (collectively called as a sacrificial layer 840) are separately arranged on the fixed electrode layer 200 through a variety of processes such as lithography, etching, and photoresist removal in which a number of slits 842 are formed between the blocks 841. For example, the sacrificial material 830 is molybdenum (Mo) or other similar material.

Figure 12A:
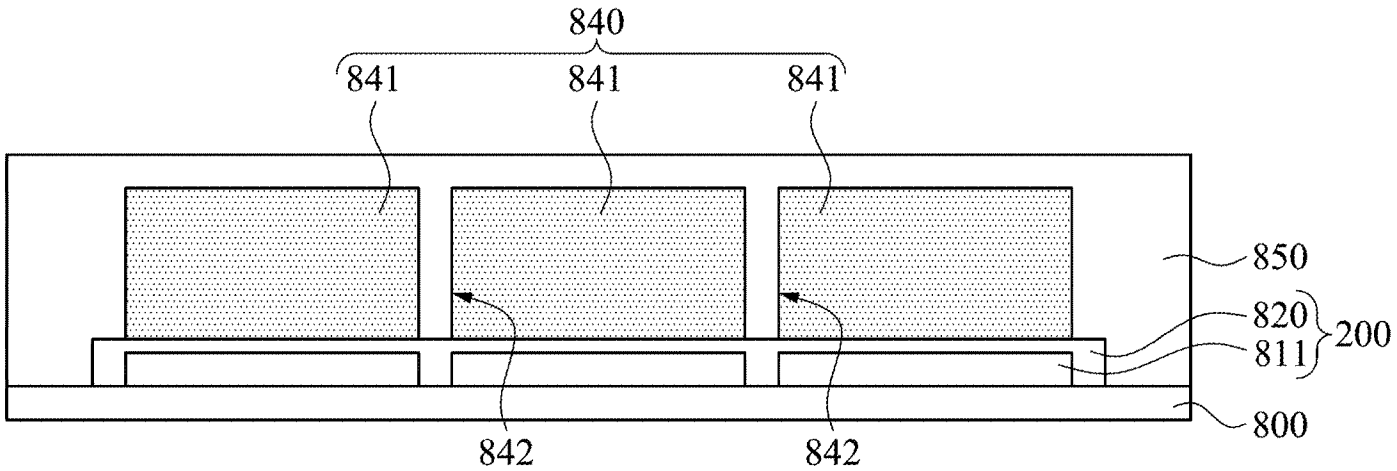
FIG. 12A to FIG. 12B are continual schematic side views of detailed steps of a step 93 of FIG. 9.
Figure 12B:
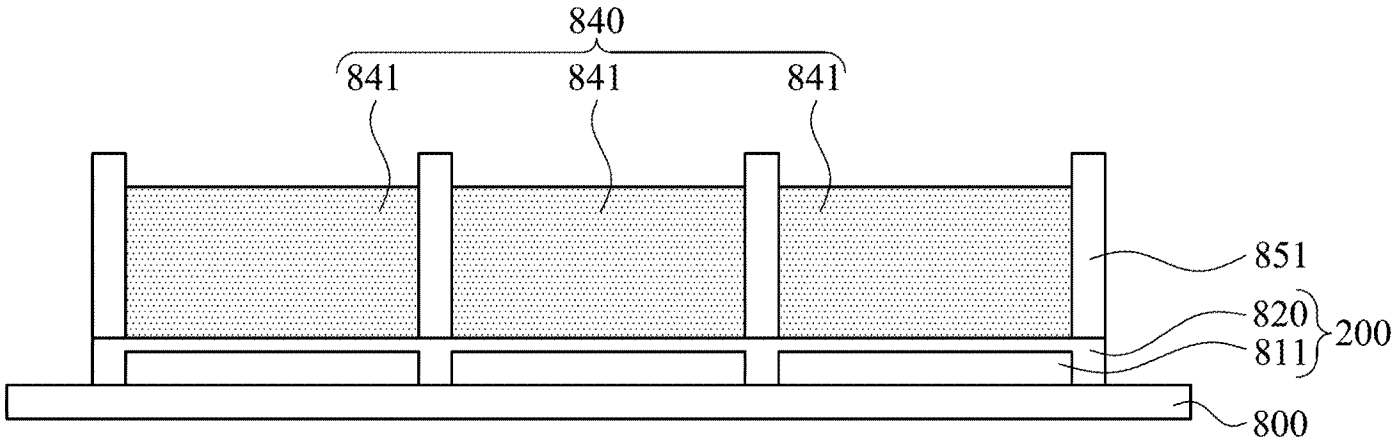

FIG. 12A and FIG. 12B are continual schematic side views of detailed steps of a step 93 of FIG. 9. More specifically, as shown in FIG. 11A and FIG. 11B, the step 93 further includes detailed steps as follows. A partition material 850 is formed on the substrate 800, the sacrificial layer 840 and the fixed electrode layer 200 according to a film coating method (FIG. 12A). Next, the aforementioned spacers 851 are formed to be separately arranged on the fixed electrode layer 200 through a variety of processes such as lithography, etching, and photoresist removal, so that the aforementioned spacers 851 are located in the slits 842, respectively (FIG. 12B). For example, the partition material 850 includes SiON or a similar material.

Figure 13A:
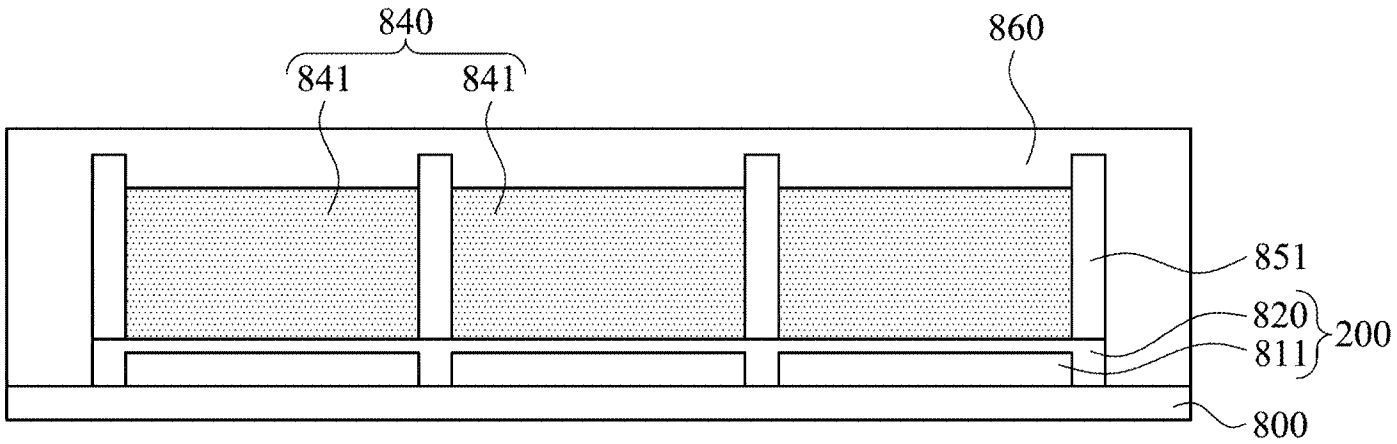
FIG. 13A to FIG. 13E are continual schematic side views of detailed steps of a step 94 of FIG. 9.
Figure 13B:
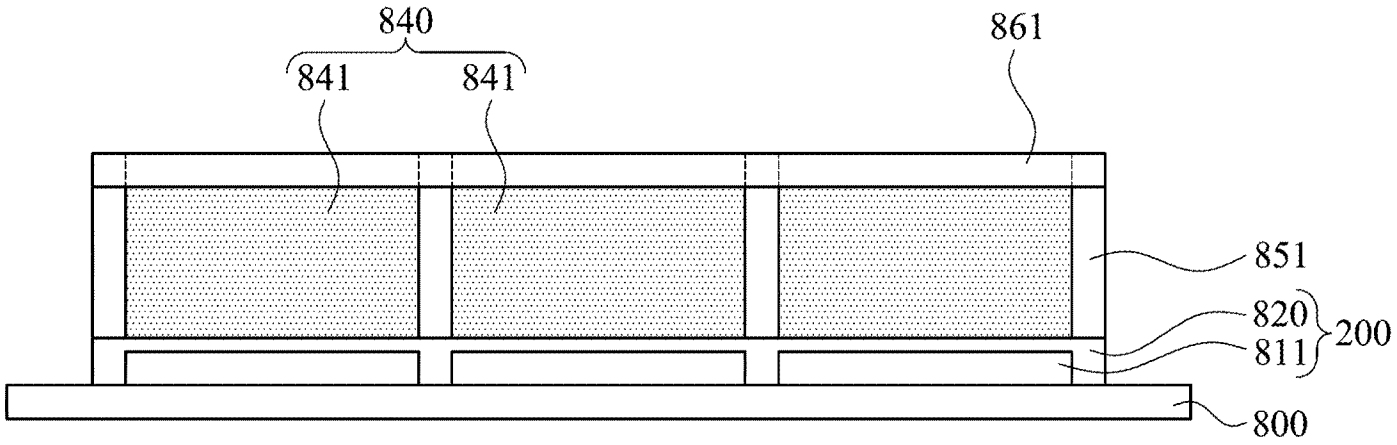
Figure 13C:
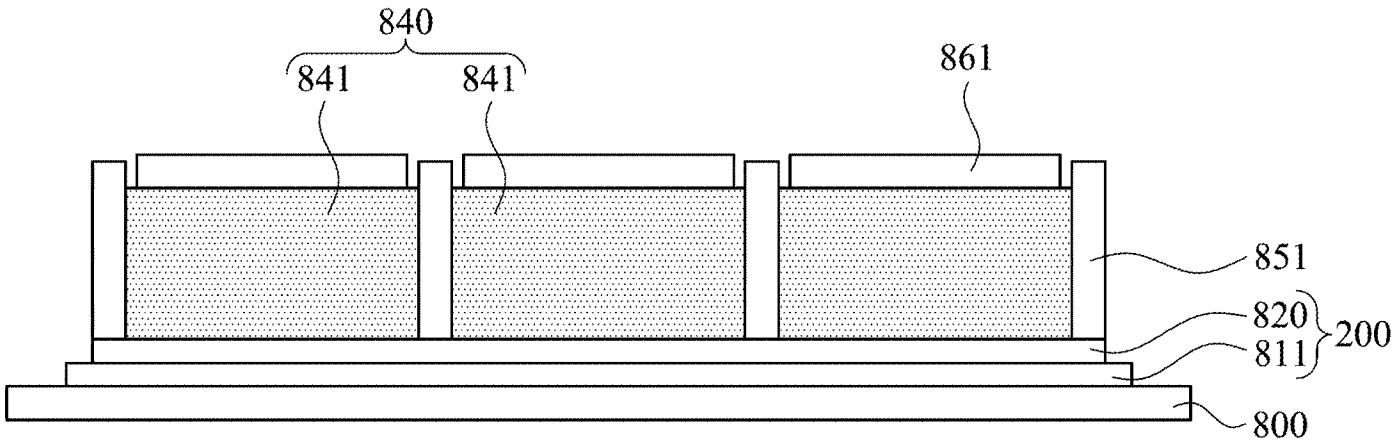
Figure 13D:
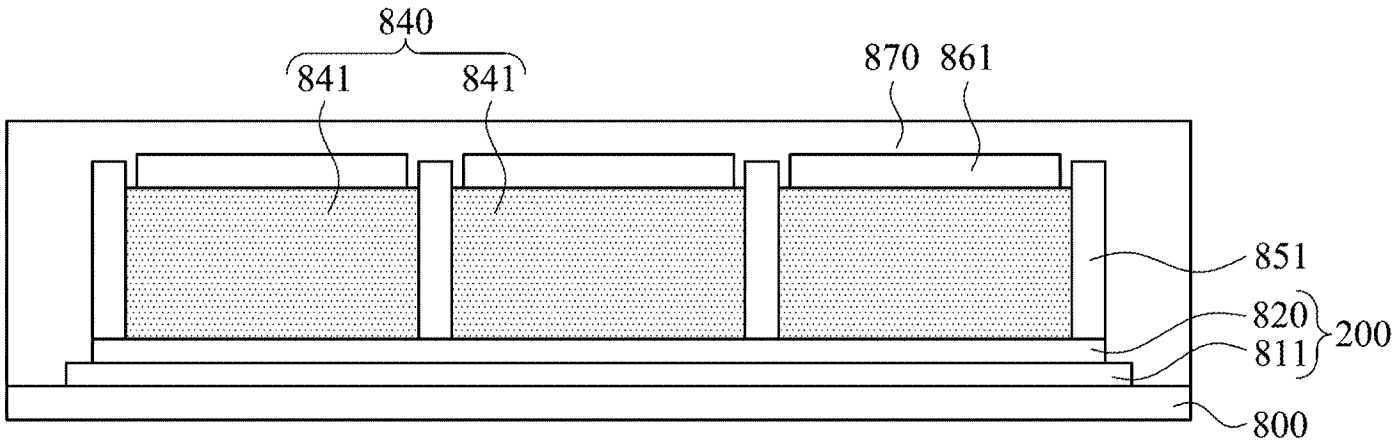
Figure 13E:
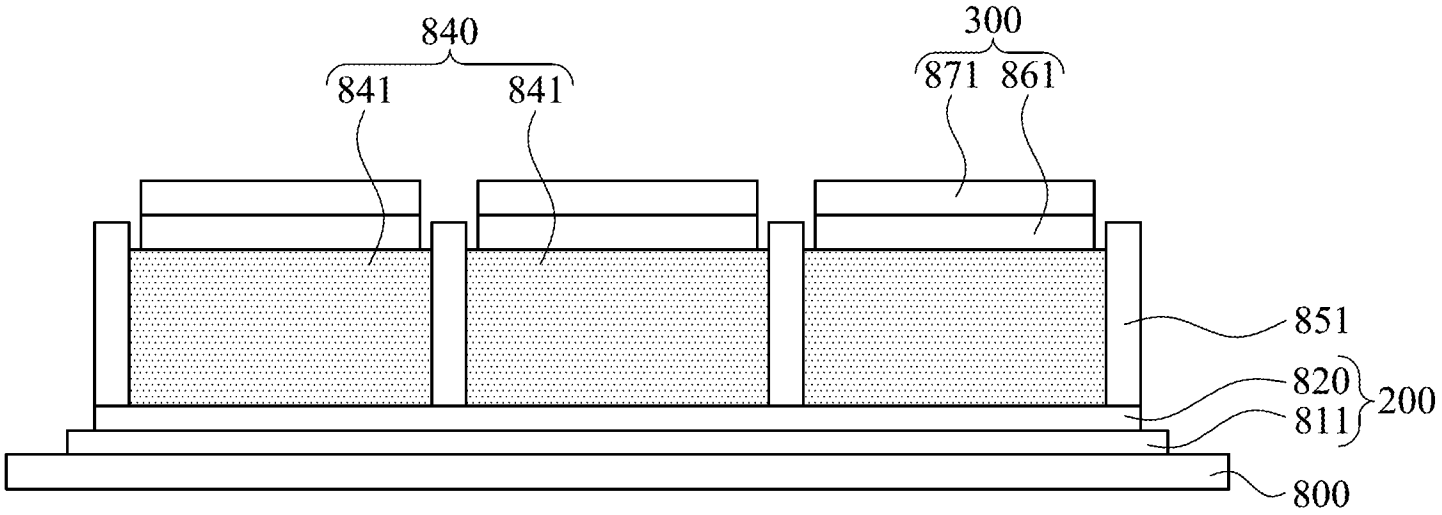

FIG. 13A to FIG. 13E are continual schematic side views of detailed steps of the step 94 of FIG. 9, and FIG. 13C is the side view of FIG. 13B. More specifically, as shown in FIG. 13A and FIG. 13E, the step 94 further includes detailed steps as follows. Another dielectric film 860 is formed on the substrate 800, the fixed electrode layer 200, the sacrificial layer 840, and the spacers 851 according to a film coating method (FIG. 13A), and then the other dielectric film 860 is processed through a variety of processes such as lithography, etching, and photoresist removal, so as to form a number of second dielectric layers 861 on the blocks 841 of the sacrificial layer 840, respectively, and each of the second dielectric layers 861 is located between any two adjacent ones of the aforementioned spacers 851 (FIG. 13B and FIG. 13C). Next, another metal film 870 is formed on the substrate 800, the fixed electrode layer 200, the sacrificial layer 840, the second dielectric layer 861, and the spacers 851 according to a film coating method (FIG. 13D). Next, the metal film 870 is processed through a variety of processes such as lithography, etching, and photoresist removal, so that the flexible electrode lines 871 are formed to be respectively disposed on the second dielectric layer 861 (FIG. 13E).

Figure 14A:
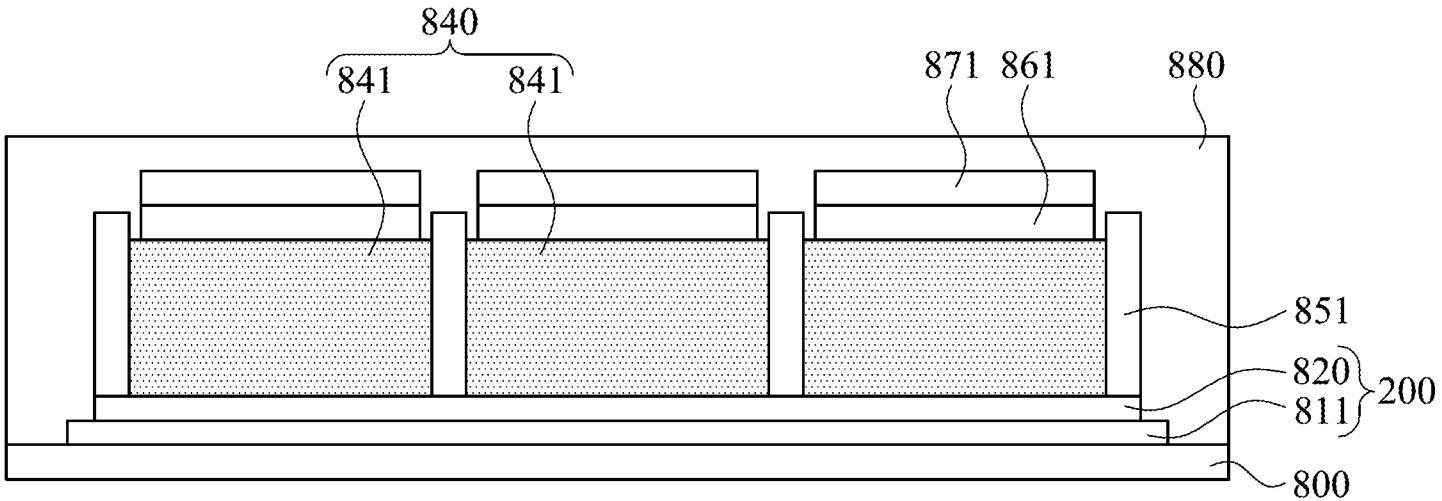
FIG. 14A to FIG. 14C are continual schematic side views of detailed steps of a step 95 of FIG. 9.
Figure 14B:
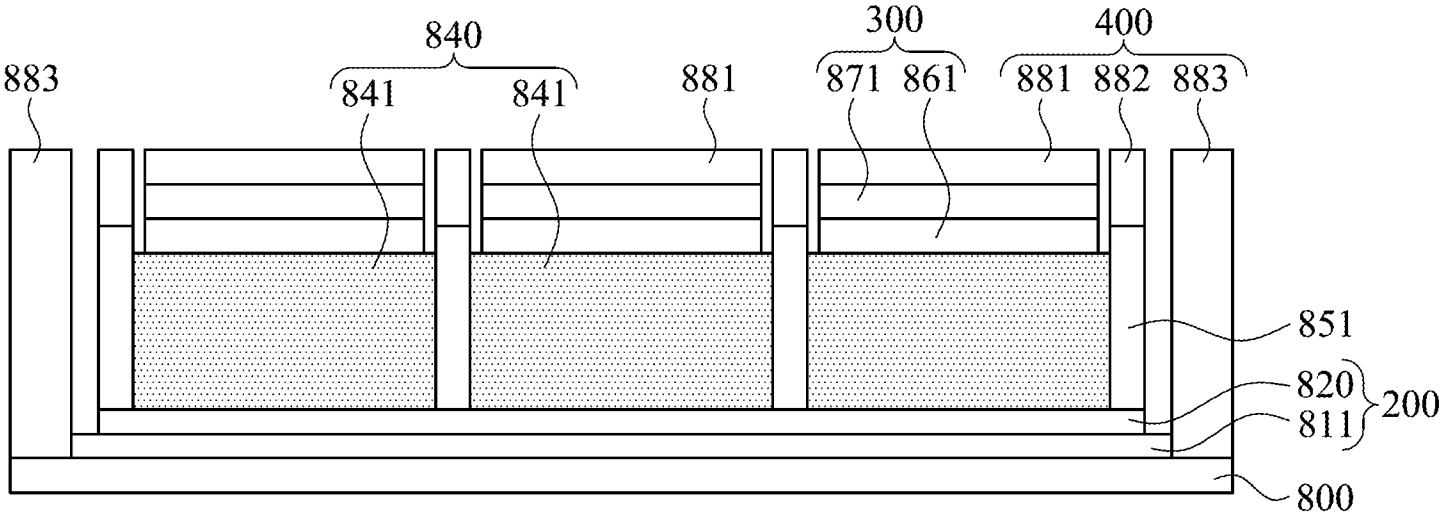
Figure 14C:
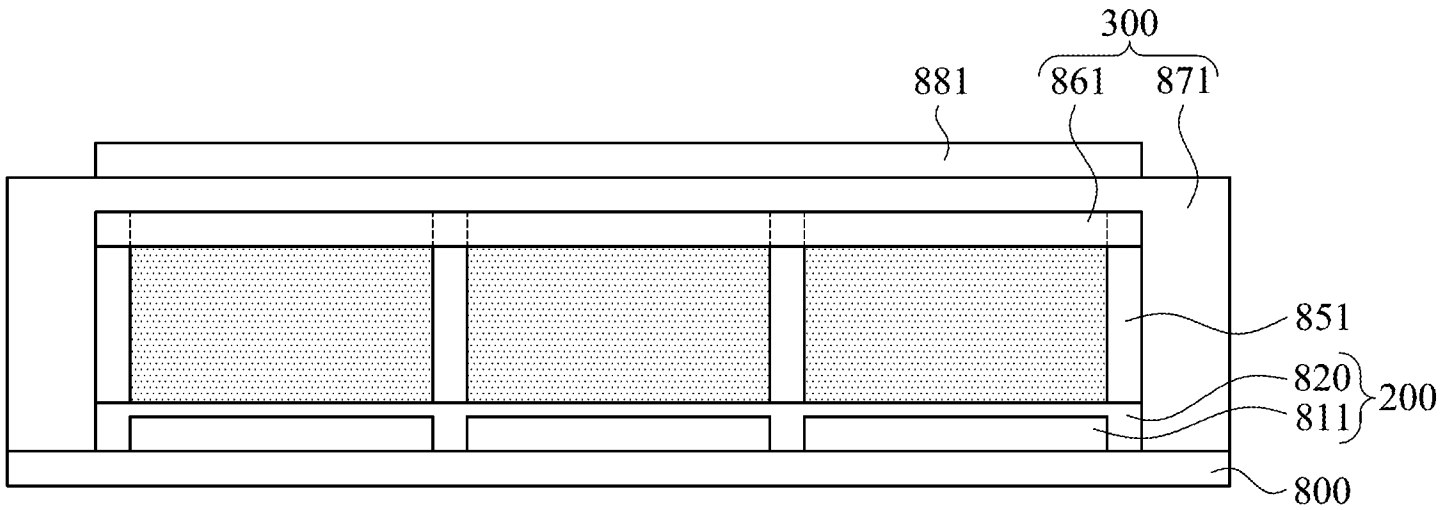

FIG. 14A to FIG. 14C are continual schematic side views of detailed steps of the step 95 of FIG. 9, and FIG. 14C is the side view of FIG. 14B. More specifically, as shown in FIG. 14A and FIG. 14C, the step 95 further includes detailed steps as follows. A protective material 880 is formed on the substrate 800, the fixed electrode layer 200, the sacrificial layer 840, and the movable electrode layers 300 according to a film coating method (FIGS. 14A and 14B), and then the protective material 880 is processed through a variety of processes such as lithography, etching, and photoresist removal, so that a number of first protective films 881 are formed on the movable electrode layers 300, a number of second protective films 882 are formed on the spacers 851, and a number of outer sidewalls 883 are formed on the substrate 800 (FIG. 14B and FIG. 14C).

More specifically, the step 96 further includes detailed steps as follows. As shown in FIG. 14B to FIG. 14C, at least one through hole (not shown) is formed on one of the outer sidewalls 883 to communicate with the sacrificial layer 840. Next, an etching gas is injected into the inside of the sacrificial layer 840 from the through hole. The blocks 841 of the sacrificial layer 840 are etched such that the sacrificial layer 840 is completely turned into a gas product. Then, the gas product is completely removed by a pumping device (not shown) to define the gaps G between the fixed electrode layer 200 and the protection layer group 400 (FIG. 2 and FIG. 3). For example, the etching gas includes hafnium difluoride (3XeF2) or the like, and the gas products are xenon (Xe) and molybdenum hexafluoride (MoF6).

The present disclosure should not be limited to the embodiments provided herein. It will be apparent to those skilled in the art that various modifications and variations can be made to the structure of the present disclosure without departing from the scope or spirit of the invention. In view of the foregoing, it is intended that the present disclosure cover modifications and variations of this invention provided they fall within the scope of the following claims.

What is claimed is:

1. A thermal print head structure, comprising:

a substrate;

a fixed electrode layer disposed on the substrate, and comprising at least one fixed electrode line;

at least one movable electrode layer being opposite to the fixed electrode layer, and comprising a flexible electrode line which is intersected with the at least one fixed electrode line;

a protection layer group covering the substrate, the fixed electrode layer and the at least one movable electrode layer;

a plurality of spacers located between the fixed electrode layer and the protection layer group, so that at least one gap is defined therebetween, and aligned with an intersection of the flexible electrode line and the at least one fixed electrode line; and a heat source used to heat the fixed electrode layer through the substrate, wherein, when a first potential difference is generated between the flexible electrode line and the at least one fixed electrode line, a portion of the at least one movable electrode layer is moved into the at least one gap to physically contact with the fixed electrode layer in the at least one gap, when a second potential difference is generated between the flexible electrode line and the at least one fixed electrode line, the portion of the at least one movable electrode layer is withdrawn from the at least one gap, wherein the second potential difference is less than the first potential difference.

2. The thermal print head structure of claim 1, wherein the at least one fixed electrode line is disposed on one surface of the substrate, and the fixed electrode layer further comprises a first dielectric layer covering the at least one fixed electrode line and the surface of the substrate, the at least one movable electrode layer further comprises a second dielectric layer, and the flexible electrode line is sandwiched between the second dielectric layer and the protection layer group.

3. The thermal print head structure of claim 2, wherein the protection layer group comprises at least one first protective film and a plurality of second protective films, the at least one first protective film is located between two adjacent ones of the second protective films and located on the movable electrode layer, the second protective films are respectively disposed on one side of the spacers opposite to the fixed electrode layer, wherein the flexible electrode line is sandwiched between the second dielectric layer and the at least one first protective film, and the at least one first protective film is relatively displaceable to each of the second protective films.

4. The thermal print head structure of claim 2, wherein the first potential difference is 6 to 10 volts, and the second potential difference is 0 to 4 volts.

5. The thermal print head structure of claim 1, wherein the heat source is located on one side of the substrate being opposite to the fixed electrode layer.

6. The thermal print head structure of claim 1, wherein a height of the at least one gap is between 100-110 micrometers.

7. The thermal print head structure of claim 1, wherein the substrate is a glass substrate, a ceramic substrate or a silicon crystal material substrate.

8. A printing device, comprising:

a thermal print head structure of claim 1;

a placement portion for being placed with a transfer-printed object thereon;

an ink ribbon disposed between the placement portion and the thermal print head structure, and disposed on one surface of the protection layer group opposite to the fixed electrode layer; and a voltage source respectively electrically connected to the at least one fixed electrode line and the flexible electrode line, wherein, when the second potential difference is generated between the flexible electrode line and the at least one fixed electrode line by the voltage source, the portion of the at least one movable electrode layer which is withdrawn from the at least one gap thermally presses the ink ribbon with the protection layer group so that inks of the ink ribbon is transferred onto the transfer-printed object.

9. A printing device, comprising:

a micro electro mechanical system (MEMS) switch assembly, comprising:

a first side surface;

a second side surface being opposite to the first side surface; and a plurality of transfer switches arranged between the first side surface and the second side surface in accordance with an array arrangement, each of the transfer switches comprising a fixed electrode region, a movable electrode region, and a gap located between the fixed electrode region and the movable electrode region, and the movable electrode region is allowed to move into the gap;

a heat source disposed at the first side surface;

an ink ribbon disposed at the second side surface; and a voltage source electrically connected to the transfer switches, and used to switch any of the transfer switches for moving the movable electrode region to one of the fixed electrode region and the ink ribbon via the gap.

10. The printing device of claim 9, wherein the MEMS switch assembly comprises:

a substrate thermally coupled to one surface of the heat source;

a fixed electrode layer comprising a plurality of fixed electrode lines disposed on one surface of the substrate being opposite to the heat source, respectively;

a plurality of movable electrode layers which are coplanar collectively, and each of the movable electrode layers comprising a flexible electrode line which is intersected with each of the fixed electrode lines;

a protection layer group covering the substrate, the fixed electrode layer and the movable electrode layers, and thermally coupled to the ink ribbon; and a plurality of spacers located between the fixed electrode layer and the protection layer group, so that each of intersections formed by the flexible electrode lines and the fixed electrode lines and aligned with one of the gaps is formed to be one of the transfer switches.

11. The printing device of claim 10, further comprising:

a control unit electrically connected a voltage source, and used for controlling the voltage source to supply power to a specific one of the flexible electrode lines and a specific one of the fixed electrode lines according to an execution signal such that an potential difference is generated between the fixed electrode region and the movable electrode region of the corresponding one of the transfer switches.

12. The printing device of claim 11, wherein when a first potential difference is generated between the fixed electrode region and the movable electrode region of the corresponding one of the transfer switches, the movable electrode region of the transfer switch moves into the gap to physically contact with the fixed electrode layer in the gap so as to gather heat from the heat source; and when a second potential difference is generated between the fixed electrode region and the movable electrode region of the corresponding one of the transfer switches, the movable electrode region of the transfer switch is withdrawn from the gap to be thermally coupled with the ink ribbon, wherein the second potential difference is less than the first potential difference.

13. The printing device of claim 12, wherein the control unit further requests the voltage source to increase the first potential difference generated between the fixed electrode region and the movable electrode region of the corresponding one of the transfer switches for strengthening a pressing force of the movable electrode region onto the fixed electrode region.

14. The printing device of claim 12, wherein the control unit further requests the voltage source to reduce the second potential difference generated between the fixed electrode region and the movable electrode region of the corresponding one of the transfer switches for strengthening a pressing force of the movable electrode region onto the ink ribbon.

15. The printing device of claim 10, wherein the fixed electrode layer further comprises a first dielectric layer covering the fixed electrode lines and the surface of the substrate being opposite to the heat source.

16. The printing device of claim 10, wherein each of the movable electrode layers further comprises a second dielectric layer, and one of the flexible electrode lines is sandwiched between the second dielectric layer and the protection layer group.

17. The printing device of claim 9, wherein a height of each of the gaps is between 100-110 micrometers.

18. A method for manufacturing a thermal print head structure, comprising:

providing a substrate;

forming a fixed electrode layer on the substrate, wherein the fixed electrode layer comprises a plurality of fixed electrode lines;

forming a sacrificial layer on the fixed electrode layer;

forming a plurality of spacers in the sacrificial layer, wherein the spacers are separately arranged in the sacrificial layer in accordance with an array arrangement;

forming a plurality of movable electrode layers on one surface of the sacrificial layer being opposite to the fixed electrode layer, wherein each of the movable electrode layers comprising a flexible electrode line which is intersected with each of the fixed electrode lines;

forming a protection layer group to cover the substrate, the fixed electrode layer and the movable electrode layers; and removing the sacrificial layer such that the spacers separate a plurality of gaps between the fixed electrode layer and the protection layer group.

19. The method for manufacturing the thermal print head structure of claim 18, wherein the step of removing the sacrificial layer, further comprising:

etching the sacrificial layer with an etching gas to transform the sacrificial layer in a gaseous product; and pumping the gaseous product away from a location between the fixed electrode layer and the protection layer group by using an air pumping device so as to separate the gaps.

20. The method for manufacturing the thermal print head structure of claim 18, further comprising:

placing a heat source on one side of the substrate being opposite to the fixed electrode layer.

* * * * *